US010242837B2

(12) United States Patent
Yamada et al.

(10) Patent No.: US 10,242,837 B2
(45) Date of Patent: Mar. 26, 2019

(54) ANODE AND X-RAY GENERATING TUBE, X-RAY GENERATING APPARATUS, AND RADIOGRAPHY SYSTEM THAT USE THE ANODE

(71) Applicant: CANON KABUSHIKI KAISHA, Tokyo (JP)

(72) Inventors: Shuji Yamada, Abiko (JP); Nobuhiro Ito, Yamato (JP); Takao Ogura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 431 days.

(21) Appl. No.: 14/926,666

(22) Filed: Oct. 29, 2015

(65) Prior Publication Data

US 2016/0133430 A1 May 12, 2016

(30) Foreign Application Priority Data

Nov. 12, 2014 (JP) ..... 2014-229593

(51) Int. Cl.

| | |
|---|---|
| ***H01J 35/00*** | (2006.01) |
| ***H01J 35/08*** | (2006.01) |
| *H05G 1/30* | (2006.01) |

(52) U.S. Cl.

CPC ..... *H01J 35/08* (2013.01); *H01J 2235/086* (2013.01); *H01J 2235/088* (2013.01); *H01J 2235/186* (2013.01); *H05G 1/30* (2013.01)

(58) Field of Classification Search

CPC ..... H01J 2235/086; H01J 2235/088; H01J 2235/186; H01J 35/08; H01J 2235/081; H01J 2235/087; H01J 35/16; H01J 2235/1204; H01J 2235/1291; H01J 2235/166; H01J 35/06; H01J 35/32; H01J 2235/02; H01J 2235/084; H01J 23/005; H01J 35/14; H01J 35/18; H01J 35/101;

(Continued)

(56) References Cited

U.S. PATENT DOCUMENTS

| | | | | |
|---|---|---|---|---|
| 6,044,130 | A | 3/2000 | Inazura et al. | |
| 7,526,069 | B2 * | 4/2009 | Matsumura ..... | H01J 35/18 378/119 |

(Continued)

FOREIGN PATENT DOCUMENTS

| | | | |
|---|---|---|---|
| JP | 9-180660 | A | 7/1997 |
| JP | 2013-109937 | A | 6/2013 |
| JP | 2014-136083 | A | 7/2014 |

OTHER PUBLICATIONS

Office Action dated Jul. 5, 2018, in counterpart application JP 2014-229593 (21 pages).

*Primary Examiner* — Irakli Kiknadze
(74) *Attorney, Agent, or Firm* — Venable LLP

(57) ABSTRACT

Provided is an anode for an X-ray generating tube, which reduces a drop in the quality of an emitted X-ray due to the history of X-ray emitting operation. A target layer is formed on the inside of the edge of a support substrate. An end portion of an extended portion of a joining member, which protrudes over a support surface of the support substrate, is covered with a conductive member higher in melting point than the joining member. The conductive member is electrically connected to the target layer, thereby electrically connecting the joining member to the target layer.

24 Claims, 9 Drawing Sheets

(58) Field of Classification Search
CPC ..... H01J 35/10; H01J 2235/1013; H01J 2235/168; H01J 2235/18; H01J 35/04; H01J 2235/163; H01J 35/065; H01J 35/02; H05G 1/30
USPC ..... 378/121, 124, 143
See application file for complete search history.

(56) References Cited

U.S. PATENT DOCUMENTS

| | | | | |
|---|---|---|---|---|
| 8,416,920 | B2 * | 4/2013 | Okumura | H01J 35/12 378/143 |
| 8,792,619 | B2 * | 7/2014 | Miller | H01J 35/16 378/121 |
| 9,029,795 | B2 | 5/2015 | Sando et al. | |
| 9,326,740 | B2 * | 5/2016 | Watanabe | H05G 1/265 |
| 2003/0021377 | A1 * | 1/2003 | Turner | G01N 23/223 378/102 |
| 2007/0025516 | A1 * | 2/2007 | Bard | H01J 35/14 378/138 |
| 2014/0203183 | A1 | 7/2014 | Sando et al. | |

* cited by examiner

ANODE AND X-RAY GENERATING TUBE, X-RAY GENERATING APPARATUS, AND RADIOGRAPHY SYSTEM THAT USE THE ANODE

BACKGROUND OF THE INVENTION

Field of the Invention

The present invention relates to an anode that includes a target and is used in an X-ray generating tube configured to generate an X-ray which is applicable to, for example, medical equipment and non-destructive testing apparatus, and also relates to an X-ray generating tube that uses the anode, and an X-ray generating apparatus and a radiography system that use the X-ray generating tube.

Description of the Related Art

A general X-ray generating tube is configured to control the trajectory of electrons emitted from a cathode such as a filament with the use of a control electrode, and then accelerate the electrons toward an anode to which an electric potential higher than that of the cathode is applied. The accelerated electrons collide with a target layer formed in the anode, thereby generating an X-ray. The target layer is formed on a support substrate that transmits X-rays, and the X-ray generated in the target layer is emitted to the outside of the X-ray generating tube through the support substrate.

The X-ray generating tube has an envelope in which the cathode is mounted to one end of an insulating tube and the anode is mounted to the other end of the insulating tube in order to maintain a reduced pressure space where electrons can fly. The support substrate, through which the generated X-ray is emitted to the outside, is a part of the envelope, and is joined to the surrounding parts of the envelope in a manner that ensures vacuum sealing. An effective measure of vacuum sealing joining is brazing joining, and a method therefor is disclosed in Japanese Patent Application Laid-Open No. H09-180660. In Japanese Patent Application Laid-Open No. H09-180660, a target layer is formed from W, Ti, or the like by vapor deposition on a vacuum side inner surface of a support substrate (transmissive window), and the support substrate is joined around the target layer to a part of an envelope by brazing with the use of a brazing filler metal (that has Ag as a main component). The target layer also needs to be electrically connected to the anode by a brazing filler metal or a conductive member in order to define the electric potential of the target layer during driving.

In the manufacture of the X-ray generating tube, melting a brazing filler metal by heating the brazing filler metal to 780° C. to 900° C. is required to join, by brazing, in vacuum, the support substrate on which the target layer has been formed. The melted filler metal sometimes accidentally flows over to the target layer. The metal surface of the target layer on which W or Ti is deposited as a target, in particular, is high in affinity to a brazing filler metal, which allows the fluid brazing filler metal to cover even an electron collision portion of the target layer in some cases. When electrons collide with the covered target layer, the metal component of the brazing filler metal covering the target layer, such as Ag or Cu, emits its characteristic X-ray, which is radiation unwanted in the X-ray generating tube, with the result that an X-ray spectrum that is actually needed in the X-ray generating tube cannot be obtained. Japanese Patent Application Laid-Open No. 2013-109937 deals with this problem by providing a barrier that blocks the overflowing brazing filler metal around the target and thus preventing the generation of the unwanted X-ray. The barrier is conductive so that the target layer is electrically connected to a joining member.

The structure disclosed in Japanese Patent Application Laid-Open No. 2013-109937 is, although capable of reducing the flowing over of the brazing filler metal to the target layer in the manufacture of the X-ray generating tube, not effective enough to prevent a drop in the quality of the emitted X-ray which is observed after the X-ray emitting operation is repeated a number of times.

SUMMARY OF THE INVENTION

It is therefore an object of the present invention to provide an anode that reduces a drop in quality of an emitted X-ray due to an operation history of an X-ray generating tube. It is another object of the present invention to provide an X-ray generating tube configured to emit an X-ray of excellent characteristics by using the anode, and a highly reliable X-ray generating apparatus and radiography system that use the X-ray generating tube.

According to a first embodiment of the present invention, there is provided an anode, including:

- a target layer configured to generate an X-ray;
- a support substrate, which extends farther outwardly than an edge of the target layer, the support substrate including a support surface where the target layer is supported;
- a tubular anode member, which is joined to a side surface of the support substrate via a joining member, the joining member including an extended portion, which extends from the side surface to the support surface,
- a conductive member that has a melting point higher than a melting point of the joining member, and
- wherein the joining member is electrically connected to the target layer by covering the extended portion with the conductive member.

According to a second embodiment of the present invention, there is provided an X-ray generating tube, including:

- the anode of the first embodiment the present invention;
- a cathode including an electron emitting source configured to emit electrons toward the target layer; and
- an insulating tube configured to insulate the anode and the cathode, and to form a vacuum container together with the anode and the cathode.

According to a third embodiment of the present invention, there is provided an X-ray generating apparatus, including:

- the X-ray generating tube of the second embodiment of the present invention; and
- a tube voltage circuit configured to apply a tube voltage to the cathode and the anode of the X-ray generating tube.

According to a fourth embodiment of the present invention, there is provided a radiography system, including:

- the X-ray generating apparatus of the third embodiment of the present invention;
- an X-ray detecting apparatus configured to detect an X-ray that has been emitted from the X-ray generating apparatus and transmitted through a subject; and
- a system control apparatus configured to control the X-ray generating apparatus and the X-ray detecting apparatus in a coordinated manner.

Further features of the present invention will become apparent from the following description of exemplary embodiments with reference to the attached drawings.

DESCRIPTION OF THE EMBODIMENTS

Embodiments of the present invention are described in the following with reference to the attached drawings, but the present invention is not limited to these embodiments. Note that, well-known or publicly known technologies in the art are applied to parts which are not specifically illustrated or described herein.

<X-ray Generating Tube>

Figure 5:
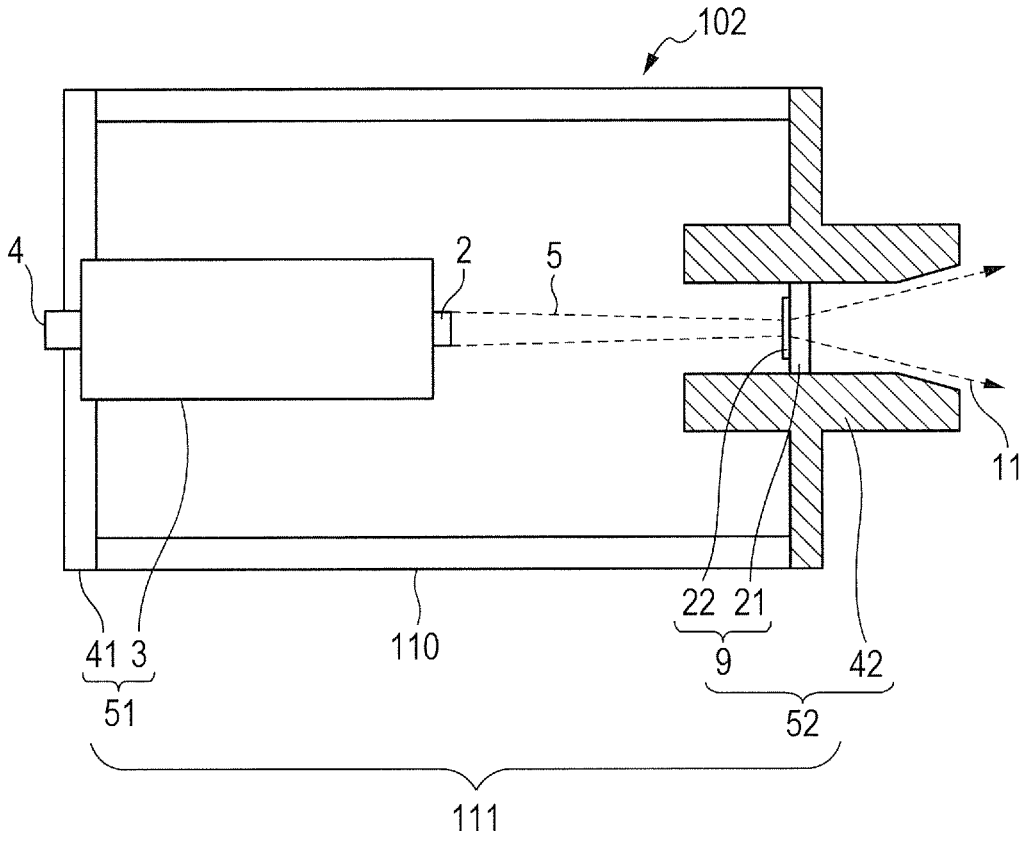
FIG. 5 is a sectional view taken along a tube axial direction to schematically illustrate the structure of an X-ray generating tube according to an embodiment of the present invention.

FIG. 5 is a diagram for schematically illustrating the structure of an X-ray generating tube according to an embodiment of the present invention. An X-ray generating tube 102 of this example is a transmissive X-ray generating tube that includes a transmissive target. In the transmissive target, a support substrate 21 configured to support a target layer 22 is a transmissive substrate through which an X-ray is transmitted. The support substrate 21 in the present invention is not limited to a transmissive substrate.

The X-ray generating tube 102 generates an X-ray 11 by irradiating the target layer 22 with an electron beam 5, which is emitted from an electron emitting portion 2 included in an electron emitting source 3. Accordingly, the target layer 22 is formed on the electron emitting source 3 side of the support substrate 21, and the electron emitting portion 2 is opposed to the target layer 22.

Electrons contained in the electron beam 5 are accelerated to an incident energy level necessary to generate an X-ray in the target layer 22 by an accelerating electric field formed in an internal space 13 of the X-ray generating tube 102 which is sandwiched between a cathode 51 and an anode 52.

The anode 52 includes at least a target 9 and a tubular anode member 42, and functions as an electrode that defines the anode potential of the X-ray generating tube 102.

The tubular anode member 42 is made of a conductive material and is electrically connected to the target layer 22. The support substrate 21 of the target 9 is joined to the tube inner circumference of the tubular anode member 42 via a joining member (not shown in FIG. 5), to thereby hold the target 9 by the tubular anode member 42. The tubular anode member 42 contains heavy metal such as tungsten or tantalum and, as illustrated in FIG. 5, is shaped so as to include a portion that stretches toward a space in front of the target 9 (toward the outside of the X-ray generating tube 102) without losing an opening, thereby functioning as a collimator that controls the emission angle of an X-ray.

The internal space 13 of the X-ray generating tube 102 is vacuum in order to secure a mean free path for the electron beam 5. The vacuum inside the X-ray generating tube 102 is preferably $1\times10^{-8}$ Pa or more and $1\times10^{-4}$ Pa or less, more preferably from the viewpoint of the lifetime of the electron emitting source 3, $1\times10^{-8}$ Pa or more and $1\times10^{-6}$ Pa or less. The electron emitting portion 2 and the target layer 22 are arranged in the internal space 13 or on an inner surface of the X-ray generating tube 102.

The internal space 13 of the X-ray generating tube 102 is put under vacuum by exhausting the internal space 13 with the use of an exhaust pipe (not shown) and a vacuum pump (not shown), and then sealing the exhaust pipe. A getter (not shown) may be formed in the internal space 13 of the X-ray generating tube 102 for the purpose of maintaining the vacuum.

The X-ray generating tube 102 has as its trunk an insulating tube 110 for the purpose of electrically insulating the electron emitting source 3, which is set to the cathode potential, and the target layer 22, which is set to the anode potential, from each other. The insulating tube 110 is made of an insulating material such as a glass material or a ceramic material. The insulating tube 110 is connected to the tubular anode member 42 at one end in the tube axial direction and to a cathode member 41 at the other end in the tube axial direction. The insulating tube 110 thus has a function of defining the gap between the electron emitting portion 2 and the target layer 22 as illustrated in FIG. 5.

A member which has airtightness for maintaining vacuum and which is solid enough to withstand atmospheric pressure is preferred for an envelope 111. The envelope 111 is a vacuum container that is made up of the insulating tube 110, the cathode 51, which includes the electron emission source 3, and the anode 52, which includes the target 9. The cathode 51 and the anode 52 are connected to the opposite ends of the insulating tube 110, respectively, to form a part of the envelope 111. Similarly, the support substrate 21, which serves as a transmissive window through which an X-ray generated in the target layer 22 is taken out of the X-ray generating tube 102, forms a part of the envelope 111.

The electron emitting source 3 is arranged so that the electron emitting portion 2 is opposed to the target layer 22 of the target 9. For example, a hot cathode such as a tungsten filament or an impregnated cathode, or a cold cathode such as a carbon nanotube can be used for the electron emitting source 3. The electron emitting source 3 may include a grid electrode (not shown) and an electrostatic lens electrode (not shown) for the purpose of controlling the beam diameter, electron current density, on/off timing, and the like of the electron beam 5.

The cathode 51 includes the conductive cathode member 41 and the electron emitting source 3. The cathode member 41 is a component of the envelope 111, and a metal material having a linear expansion coefficient close to that of the insulating tube 110 is therefore selected for the cathode member 41.

<Anode>

Figure 1A:
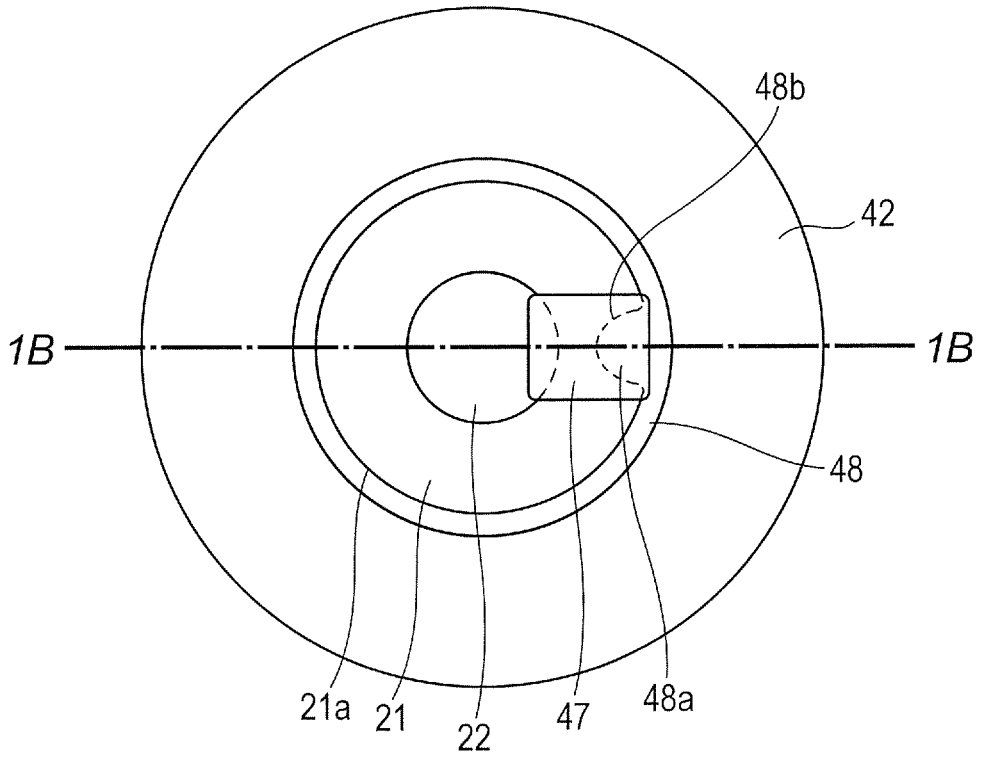
FIG. 1A is a diagram for schematically illustrating the structure of an anode according to an embodiment of the present invention, in the form of a plan view viewed from the cathode side of an X-ray generating tube.
Figure 1B:
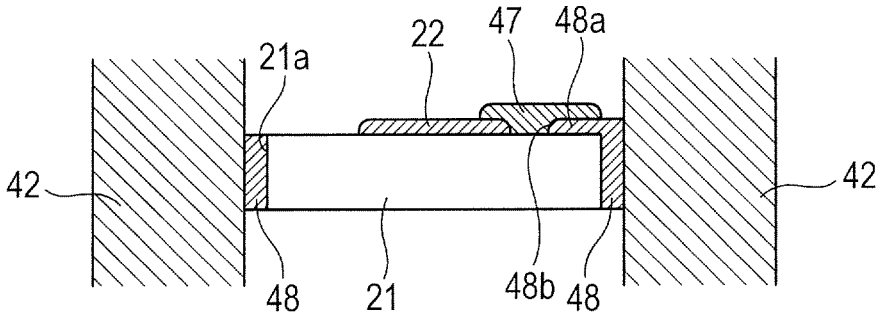
FIG. 1B is a sectional view taken along the line 1B-1B in FIG. 1A.
Figure 2A:
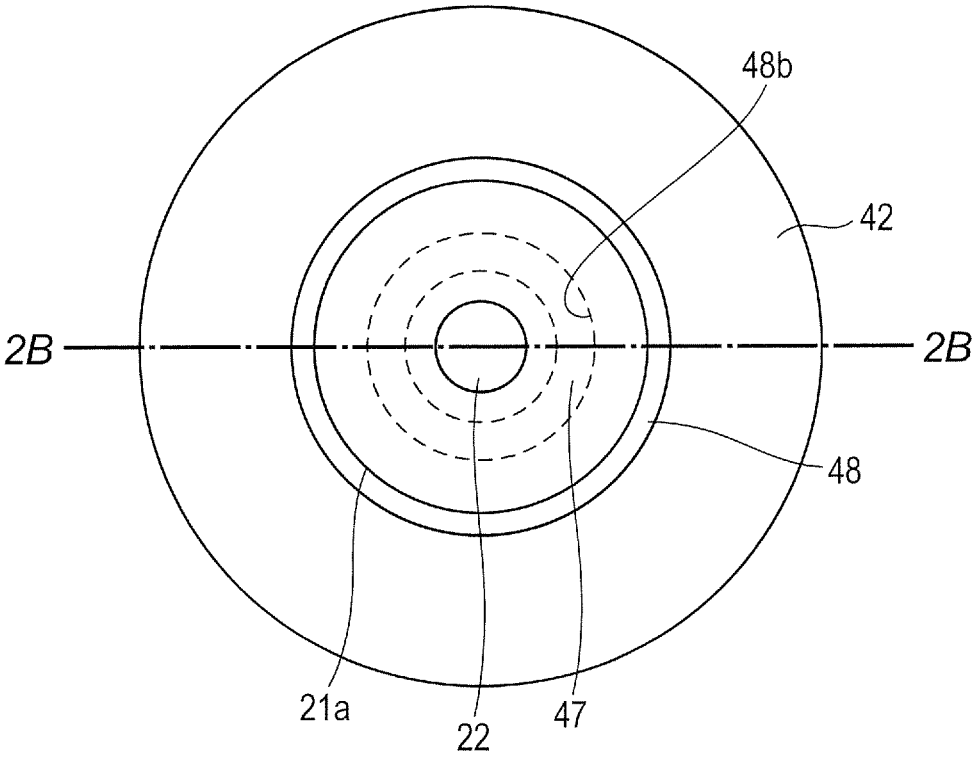
FIG. 2A is a diagram for schematically illustrating the structure of an anode according to another embodiment of the present invention, in the form of a plan view viewed from the cathode side of the X-ray generating tube.
Figure 2B:
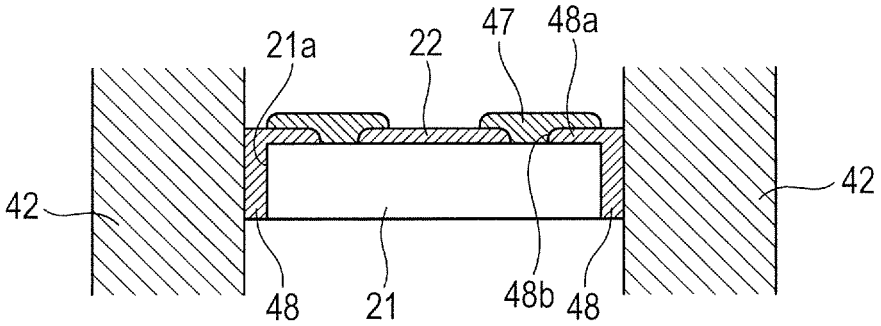
FIG. 2B is a sectional view taken along the line 2B-2B in FIG. 2A.
Figure 3A:
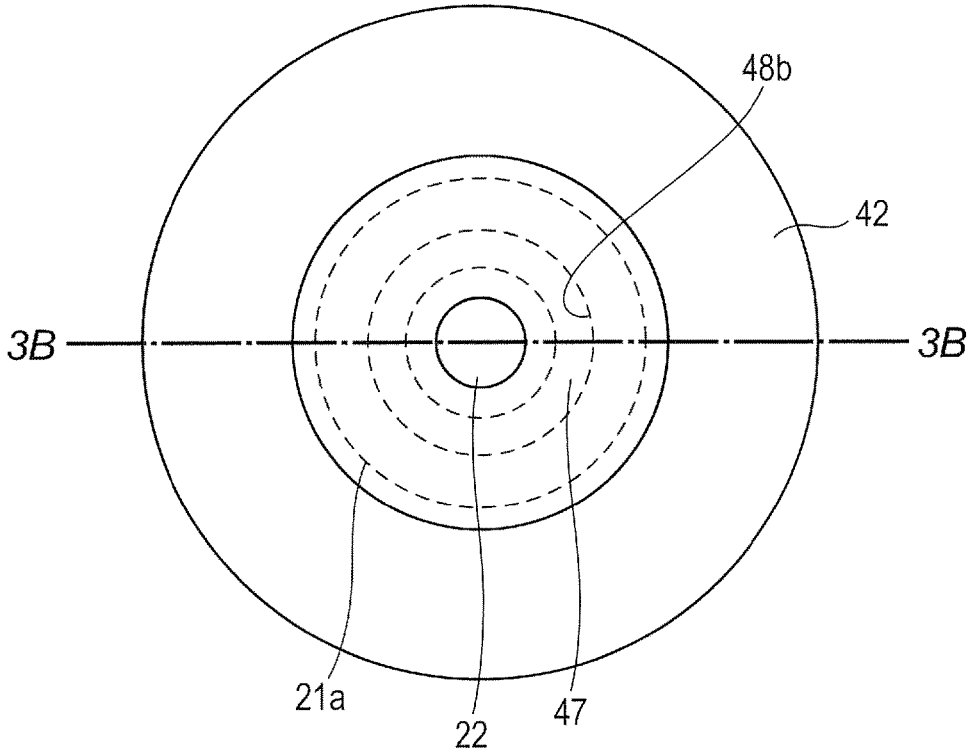
FIG. 3A is a diagram for schematically illustrating the structure of an anode according to another embodiment of the present invention, in the form of a plan view viewed from the cathode side of the X-ray generating tube.
Figure 3B:
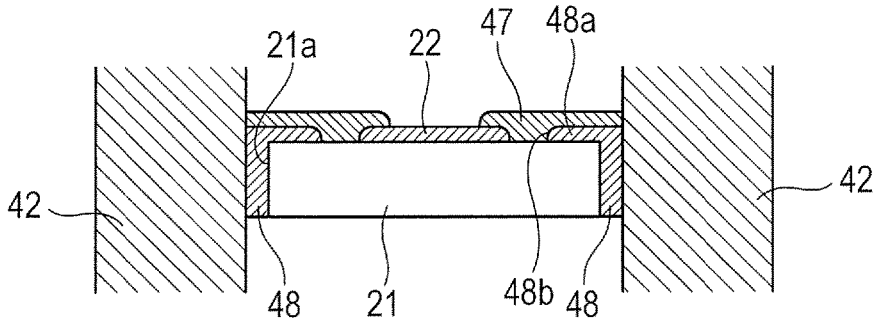
FIG. 3B is a sectional view taken along the line 3B-3B in FIG. 3A.
Figure 4A:
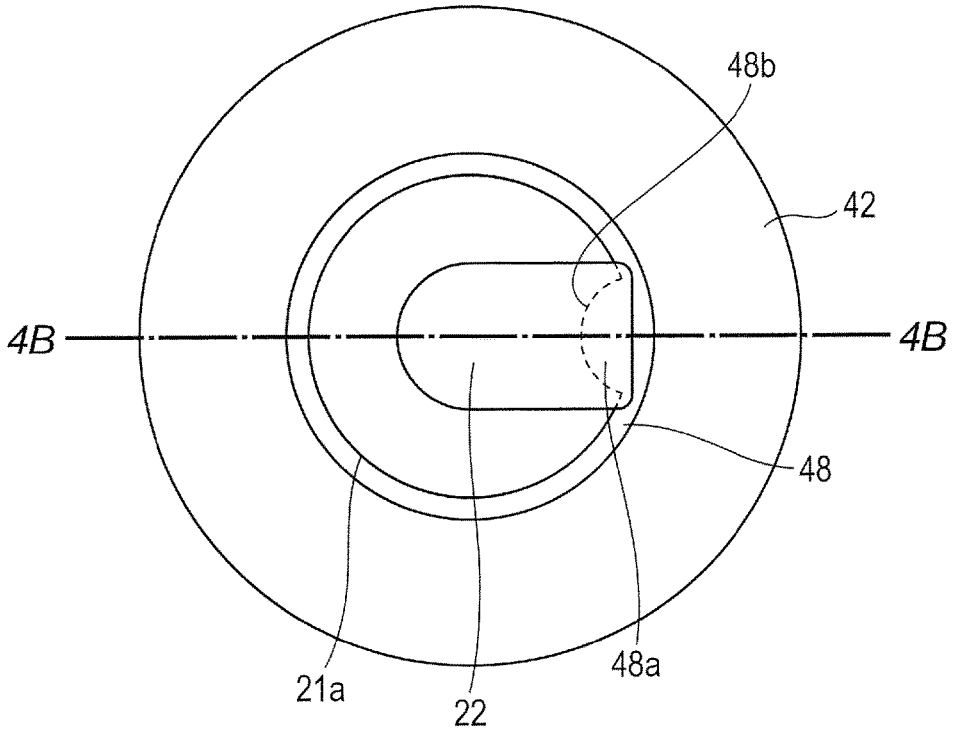
FIG. 4A is a diagram for schematically illustrating the structure of an anode according to another embodiment of the present invention, in the form of a plan view viewed from the cathode side of the X-ray generating tube.
Figure 4B:
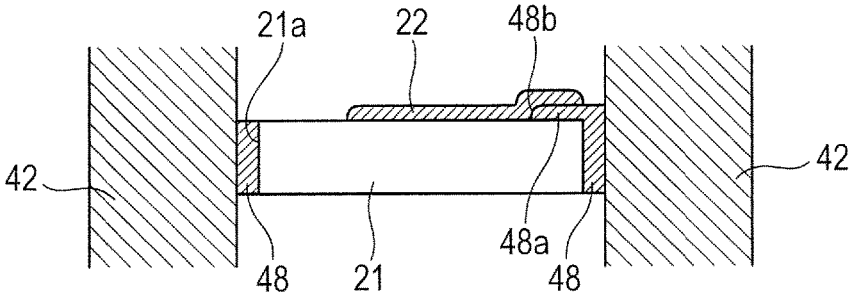
FIG. 4B is a sectional view taken along the line 4B-4B in FIG. 4A.

FIG. 1A and FIG. 1B are diagrams for schematically illustrating the structure the anode according to an embodiment of the present invention. FIG. 1A is a view of the anode 52 of this example that is viewed from the cathode 51 side in the X-ray generating tube, and FIG. 1B is a sectional view taken along the line 1B-1B in FIG. 1A. FIGS. 2A and 2B to FIGS. 4A and 4B are diagrams for schematically illustrating the structures of the anode according to other embodiments of the present invention described later. Similarly to FIGS. 1A and 1B, FIG. 2A, FIG. 3A, and FIG. 4A are each a view of the anode 52 of the example that is viewed from the cathode 51 side in the X-ray generating tube, and FIG. 2B, FIG. 3B, and FIG. 4B are sectional views taken along the line 2B-2B in FIG. 2A, the line 3B-3B in FIG. 3A, and the line 4B-4B in FIG. 4A, respectively.

The anode 52 of the present invention includes the tubular anode member 42 and the target 9 as described above. The target 9 includes at least the target layer 22, which contains a target metal, and the support substrate 21, which supports the target layer 22 on a support surface. The support surface of the support substrate 21 is on the side opposed to the electron emitting portion 2 in the X-ray generating tube 102. The target 9 emits an X-ray from a surface of the support substrate 21 that is opposite from the side where the target layer 22 is formed when the target layer 22 is irradiated with an electron beam. Accordingly, one side of the tubular interior of the tubular anode member 42 that faces the target layer 22 is a path of the electron beam 5 and the other side is a path along which the X-ray 11 is taken out.

The contour of the support substrate 21 is that of a flat board having the support surface on which the target layer 22 is formed and the opposite surface as illustrated in FIGS. 1A and 1B. For example, a rectangular parallelepiped shape, a disc shape, or a truncated cone shape is employed as the contour of the support substrate 21. The support substrate 21 in this example has a disc shape.

The disc-shaped support substrate 21 has a diameter of 2 mm or more and 10 mm or less on one side so that the target layer 22 that allows an electron beam to focus at a necessary focal spot size can be formed. The thickness of the support substrate 21 is set to 0.3 mm or more and 3 mm or less, thereby obtaining heat transmission characteristics and X-ray transmittance in the substrate plane direction. In the case where the support substrate is a diamond base having a rectangular parallelepiped shape, this diameter range is translated into the shorter-side lengths and longer-side lengths of the faces of the rectangular parallelepiped.

The target layer 22 contains as a target metal a metal element that is high in atomic number, melting point, and relative density. The target metal is selected from among metal elements with an atomic number of 42 or higher. A target metal that is preferred from the viewpoint of affinity to the support substrate 21 is selected from the group consisting of tantalum, molybdenum, and tungsten of which carbides have a negative standard free energy of formation. The target metal may be contained in the target layer 22 as a single-component pure metal or an alloy composition pure metal, or as a metal compound such as a carbide, nitride, or oxynitride of the metal.

The thickness of the target layer 22 is selected from a range of 1 μm or more and 12 μm or less. The lower limit and upper limit to the thickness of the target layer 22 are determined from the viewpoints of securing the X-ray output intensity and reducing the boundary stress, respectively. A preferred range of the target layer thickness is 2 μm or more and 8 μm or less.

As illustrated in FIG. 1A, the target 9 is hermetically joined to the tubular anode member 42 by joining a side surface 21*a* of the support substrate 21 to the inner circumference of the tubular anode member 42 via a joining member 48, thus becoming a part of the envelope 111. The joining member 48 is a brazing filler metal that is an alloy containing gold, silver, copper, tin, or the like. Selecting an alloy composition suitable for the members that are joined by the joining member secures adhesion between different materials.

In the case where a non-metal material such as diamond or a ceramic is used as a material of the support substrate 21, it is preferred to perform metallizing processing on the side surface 21*a* of the support substrate 21 and form a metallization layer having a metal layer and an intermediate layer in order to accomplish brazing that is more solid and highly airtight. A material favorable for the metallization layer is, for example, a metal that contains Ti, or Mo—Mn. The metallization layer is not an indispensable component of the X-ray generating tube 102 of the present invention. The support substrate 21 and the tubular anode member 42 are joined by filling the gap between the two, or a space specially provided to arrange the joining member 48, with the joining member 48. Precise processing that makes the gap between the support substrate 21 and the inner circumference of the tubular anode member as small as possible, about a few μm to 30 μm, is performed, and the amount of the material of the joining member 48 with which the gap is filled is also precisely adjusted so that the fluid material does not flow over to the target layer 22 while taking care that airtightness is not compromised by a shortage of the material of the joining member 48. Thereafter, the support substrate 21 and the tubular anode member 42 are joined at a temperature suitable for the joining member 48 that is used. In the case where a brazing filler metal BAg-8 (Japanese Industrial Standard: JIS) is used, brazing can be performed at 780° C. to 900° C. and, in order to prevent oxidization of the member, vacuum, an inert gas atmosphere, or a reductive gas atmosphere is preferred as an environment in which the brazing is performed.

The material of the joining member 48 needs to seep into the narrowest space in order to secure a high level of airtightness in vacuum sealing. A material high in fluidity, particularly on a metal surface, is therefore preferred for the joining member 48. The side surface 21*a* of the support substrate 21 and the inner circumference of the tubular anode member 42 are hermetically joined in this manner.

When joining the target 9 and the tubular anode member 42, the amount of the material of the joining member 48 is adjusted precisely so as not to create an excess or deficiency as described above. An additional measure is taken in the present invention, which is to form the target layer 22 smaller than the support surface of the support substrate 21 so that the support substrate 21 stretches farther outwardly than the edge of the target layer 22. This leaves the support surface of the support substrate 21 on which the target layer 22 is formed exposed around the target layer 22. The joining member 48 is lower in affinity to the support substrate 21 than the target layer is, and the chances of the material of the joining member 48 flowing over to the support substrate 21 when heated and melted for the joining are small. An overflow that reaches the target layer 22 is therefore unlikely to occur in the joining.

However, if the material of the joining member 48 is used in an amount larger than the just amount, the heated and fluid material of the joining member 48 may overflow onto the support surface of the support substrate 21 on which the target layer 22 is formed, thereby forming an extended portion 48*a* as illustrated in FIGS. 1A and 1B. When the electron beam 5 collides with the center of the target layer 22 in X-ray emitting operation, 90% or more of the energy of an emitted X-ray is converted into heat upon emission of the X-ray. A temperature gradient in which the temperature of the support substrate 21 rises coaxially from the outer circumference of the target layer 22 toward the center is therefore created in the tube radial direction of the tubular anode member 42. The extended portion 48*a* formed on the support substrate 21 is consequently higher in temperature than a portion sandwiched between the support substrate 21 and the tubular anode member 42, which lowers the viscosity of the extended portion 48*a* and increases the chances of the extended portion 48*a* flowing over to the target layer 22.

The present invention reduces the flowing over of the joining member 48 to the target layer 22 from the extended portion 48*a* by covering an end portion 48*b* of the extended portion 48*a* of the joining member 48 with a conductive member 47. The conductive member 47 is also connected to the target layer 22 to be used as a connection electrode that electrically connects the joining member 48 to the target layer 22.

The conductive member 47 has a melting point higher than that of the joining member 48, and covers at least the end portion 48*b* of the extended portion 48*a* of the joining member 48, which is on the inside of the support surface of the support substrate 21, preferably the entire extended portion 48*a* as illustrated in FIGS. 1A and 1B. The joining member 48 is lower in melting point than the support substrate 21, the target layer 22, and the tubular anode member 42. Structured as this, the joining member 48 is unlikely to glide up onto the conductive member 47, which covers the joining member 48, when the joining member 48 including the extended portion 48*a* rises in temperature and experiences thermal expansion because the extended portion 48*a* expands so as to be pushed back toward the edge of the support substrate 21. The extended portion 48*a* is therefore unlikely to spread in a direction toward the target layer 22 when a temperature rise in the support substrate 21 due to the X-ray emitting operation lowers the viscosity of the extended portion 48*a*. Accordingly, the chances of the joining member 48 reaching the target layer 22 in the X-ray emitting operation and thereby degrading the quality of an emitted X-ray are small.

The material of the conductive member 47 needs to have a current point higher than a temperature at which the material of the joining member 48 becomes fluid. For example, an inorganic adhesive material having conductivity such as Pyro-Duct 597-A (a product of Aremco Products Inc., melting point: 927° C.) can be used. The conductive member 47 may also be formed by partial CVD in which hexacarbonyl compound gas of tungsten or platinum is dissolved by an electron beam or an ion beam and components of the gas are deposited. A CVD film of tungsten (melting point: 3,422° C.) or platinum (melting point: 1,768° C.) can, though depending on the thickness of the CVD film, form the conductive member 47 that does not become fluid until the temperature nears the melting point of the metal used. A sufficient thickness of the conductive member 47 is a few μm to 10 μm at which the conductive member 47 is not broken by the joining member 48 that is fluid.

While the conductive member 47 covers an end portion of the target layer 22 in the example of FIGS. 1A and 1B, the target layer 22 may be formed after the conductive layer 47 to be subsequently connected to the conductive member 47.

The extended portion 48*a* is present only on a part of the edge of the support substrate 21 in the example of FIGS. 1A and 1B. In the case where the extended portion 48*a* stretches along the edge of the support substrate 21 in a ring pattern as illustrated in FIGS. 2A and 2B, the conductive member 47 may be formed in a ring pattern so as to cover the entirety of the end portion 48*b* of the extended portion 48*a* as illustrated in FIGS. 2A and 2B. The conductive member 47 may also cover the entire joining member 48 as illustrated in FIGS. 3A and 3B.

The conductive member 47 may be formed from the material of the target layer 22. FIGS. 4A and 4B are an example in which the extended portion 48*a* is present on a part of the edge of the support substrate 21 as in FIGS. 1A and 1B, and the target layer 22 is formed after the joining member 48 so as to spread to the extended portion 48*a*, thereby covering the end portion 48*b* of the extended portion 48*a* and electrically connecting to the joining member 48 at the same time. This target layer 22 can be formed by the partial CVD described above.

<X-ray Generating Apparatus>

Figure 6:
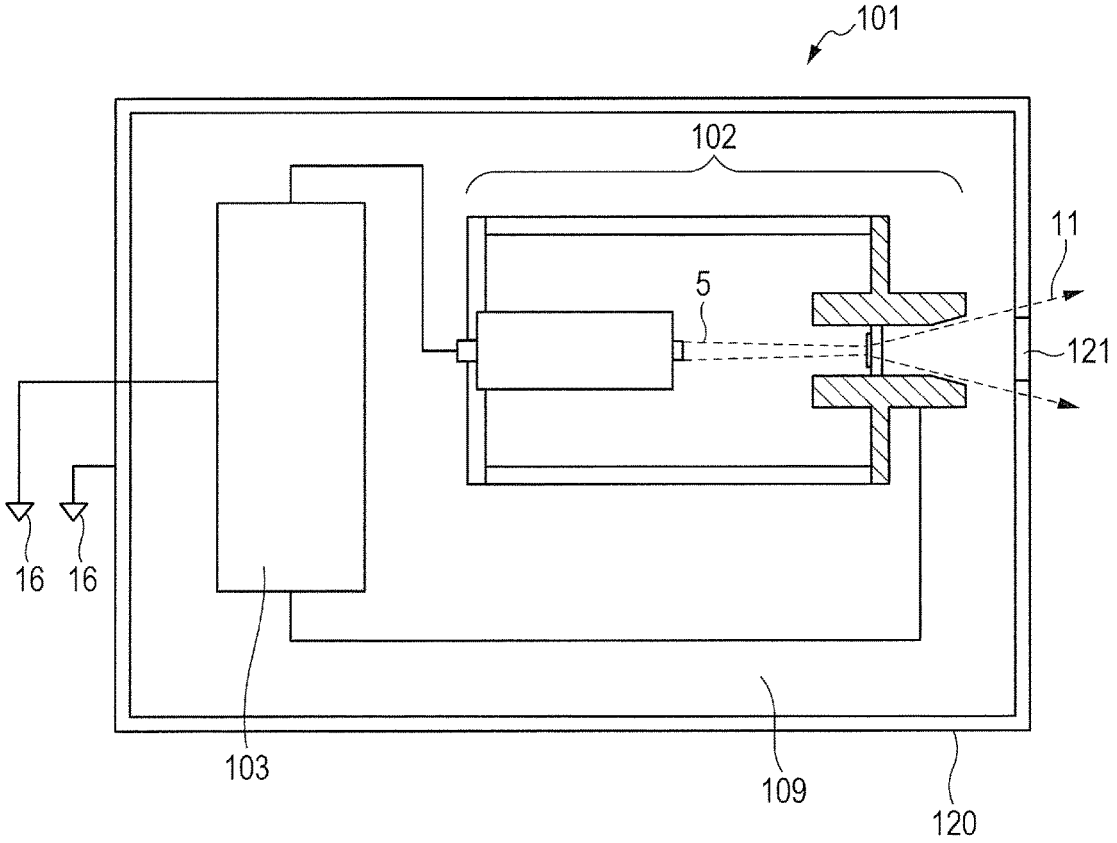
FIG. 6 is a sectional view for schematically illustrating the structure of an X-ray generating apparatus according to an embodiment of the present invention.

FIG. 6 is a diagram of an X-ray generating apparatus 101 according to the embodiment of the present invention, which is configured to take the X-ray 11 out to the front of an X-ray transmitting window 121. The X-ray generating apparatus 101 includes, in a housing container 120 where the X-ray transmitting window 121 is installed, the X-ray generating tube 102 of the present invention described above and a drive circuit 103 for driving the X-ray generating tube 102. In FIG. 6, ground electrodes 16 are illustrated. The drive circuit 103 includes at least a tube voltage circuit configured to apply a tube voltage Va between the cathode 51 and the anode 52. The drive circuit 103 may additionally include a blanking circuit, an electrostatic lens circuit, and the like to control the emitted electron amount and beam diameter of an electron gun (the electron emitting source 3).

When the drive circuit 103 applies the tube voltage Va between the cathode 51 and the anode 52, an accelerating electric field is formed between the target layer 22 and the electron emitting portion 2. By setting the tube voltage Va that is suitable for the thickness of the target layer 22 and the type of metal forming the target layer 22, an X-ray type necessary for imaging can be selected.

The housing container 120, which houses the X-ray generating tube 102 and the drive circuit 103, desirably has strength sufficient as a container and excellent heat dissipating properties. The constituent material of the housing container 120 is, for example, a metal material such as brass, iron, or stainless steel.

An excess space in the housing container 120 which remains after the X-ray generating tube 102 and the drive circuit 103 take up spaces in the housing container 120 is filled with an insulating liquid 109. The insulating liquid 109 is a liquid having electrical insulation properties, maintains electrical insulation inside the housing container 120, and serves as a cooling medium for the X-ray generating tube 102. An electrical insulation oil such as a mineral oil, a silicone oil, or a perfluoro-based oil is preferred as the insulating liquid 109.

<Radiography System>

A structural example of a radiography system, which includes the X-ray generating apparatus 101 of the present invention, is described next with reference to FIG. 7.

A system control apparatus 202 controls the X-ray generating apparatus 101 and an X-ray detector 206 in an integrated manner. The drive circuit 103 outputs, under control of the system control apparatus 202, various control signals to the X-ray generating tube 102. The drive circuit 103, which is housed in the housing container 120 along with the X-ray generating tube 102 in this embodiment, may be arranged outside the housing container 120. The control signals output by the drive circuit 103 are used to control the emission state of the X-ray 11 emitted from the X-ray generating apparatus 101.

The X-ray 11 emitted from the X-ray generating apparatus 101 is adjusted in irradiation range by a collimator unit (not shown) having a variable aperture, emitted to the outside of the X-ray generating apparatus 101, transmitted through a subject to be examined 204 (hereinafter referred to as simply "subject"), and detected by the X-ray detector 206. The X-ray detector 206 converts the detected X-ray into image signals, which are output to a signal processing portion 205.

The signal processing portion 205 performs, under control of the system control apparatus 202, given signal processing on the image signals, and outputs the processed image signals to the system control apparatus 202.

Based on the processed image signals, the system control apparatus 202 outputs to a display apparatus 203 display signals for displaying an image on the display apparatus 203.

The display apparatus 203 displays on a screen an image based on the display signals as a photographed image of the subject 204.

The radiography system of the present invention is applicable to non-destructive testing of an industrial product, and the diagnosis of human and animal pathology.

EXAMPLES

Example 1

In Example 1, an X-ray generating tube that used the anode 52 of FIGS. 2A and 2B was manufactured, and the X-ray generating apparatus 101 of FIG. 5 was further manufactured with the use of this X-ray generating tube.

Sumicrystal, which is a synthetic diamond product of Sumitomo Electric Industries, Ltd. and has a diameter of 5 mm and a thickness of 2 mm, was used for the support substrate 21. A metallization layer was formed by performing metallizing processing on the side surface 21*a* of the support substrate 21 with the use of a paste containing Ti. The target layer 22 was formed next within a radius of 3 mm from the center of the support surface of the support substrate 21 by using argon gas as a carrier gas, using sintered tungsten as a sputtering target, and depositing tungsten to a thickness of 6 μm. Thereafter, the target layer 22 was placed on the inner circumference of the tubular anode member 42 made of tungsten, and hermetically sealed by performing brazing in a vacuum atmosphere at a temperature of 840° C. with the use of the brazing filler metal BA-108, a product of Toyo Riken Co., Ltd. The flowing brazing filler metal as the material of the joining member 48 protrudes to form the extended portion 48*a* along the edge of the support substrate 21, with the end portion 48*b* formed. A micro dispenser was used next to apply the Pyro-Duct 597-A so that the end portion 48*b* of the extended portion 48 and the end portions of the target layer 22 were covered, thereby forming the conductive member 47 in a ring pattern and obtaining the anode 52 of Example 1.

The anode 52 of Example 1 was used to further manufacture the X-ray generating tube 102 of FIG. 5. The X-ray generating tube 102 was tested for its static withstand voltage, and revealed to be capable of maintaining a tube voltage of 150 kV for 10 continuous minutes without discharge. The static withstand voltage test in Example 1 is for evaluating the discharge withstand voltage by applying a tube voltage between the anode 52 and the cathode 51 without generating the electron beam 5 from the electron emitting source 3 of the X-ray generating tube 102.

The drive circuit 103 having a tube voltage output portion configured to output the tube voltage between the cathode 51 and the anode 52 was next connected to the X-ray generating tube 102 and housed in the housing container 120 to manufacture the X-ray generating apparatus 101 of FIG. 6.

Figure 8:
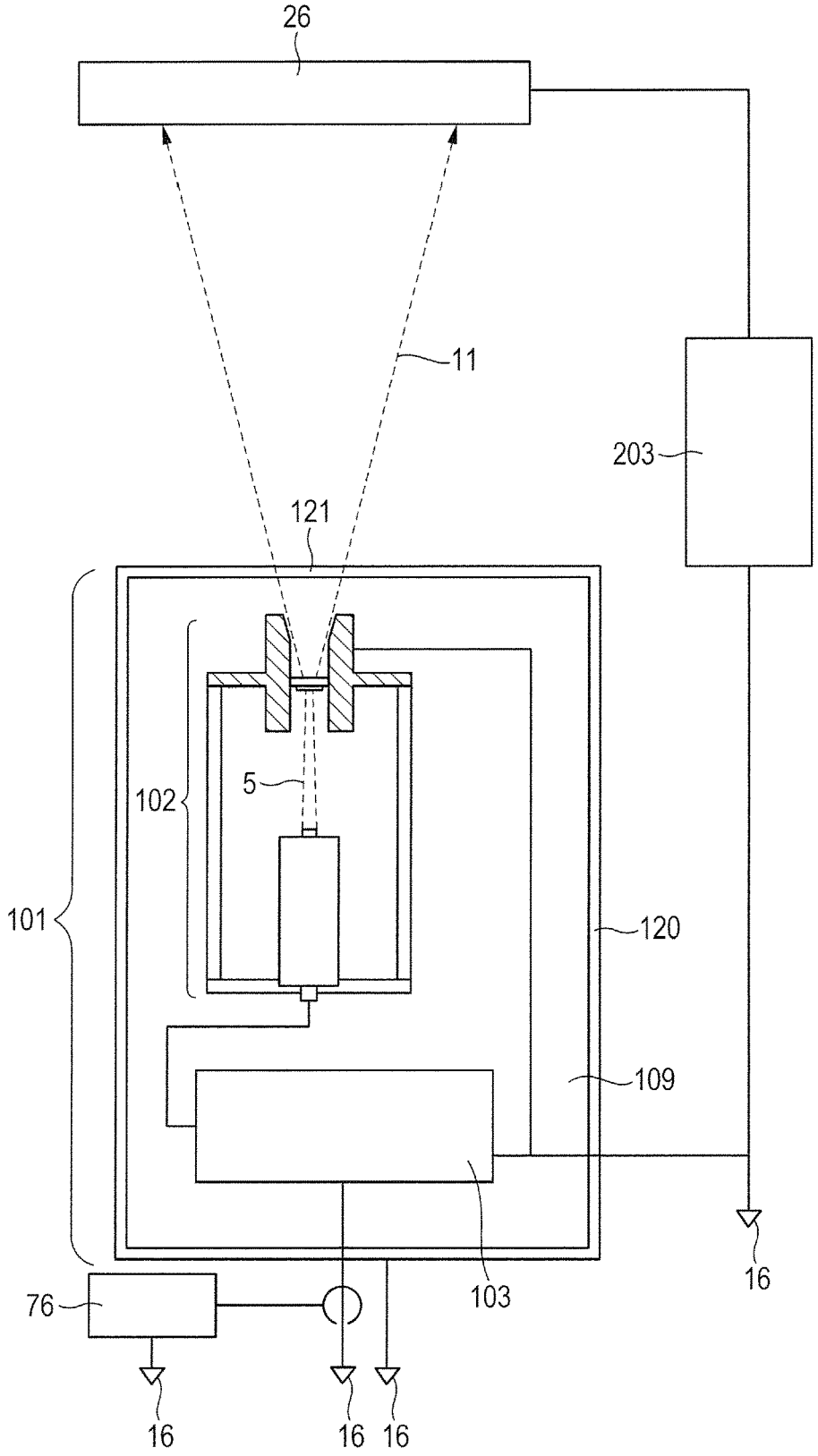
FIG. 8 is a diagram for schematically illustrating the structure of an evaluation system of an X-ray generating apparatus according to Examples of the present invention.

An evaluation system illustrated in FIG. 8 was prepared next in order to evaluate the withstand discharge performance and anode current stability of the X-ray generating apparatus 101. The evaluation system includes a radiation dosimeter 26, which is arranged at 1 m in front of the X-ray transmitting window 121 of the X-ray generating apparatus 101. The radiation dosimeter 26 is connected to the drive circuit 103 via a measurement control apparatus 203 to measure the emission output intensity of the X-ray generating apparatus 101.

The X-ray generating apparatus 101 in Example 1 was driven with pulses by repeatedly alternating a 3-second electron irradiation period and a 57-second non-irradiation period, and by setting the tube voltage of the X-ray generating tube 102 to +110 kV and setting the current density of the electron beam 5 with which the target layer was irradiated to 20 mA/mm$^2$. A tube current flowing from the target layer 22 to one of the ground electrodes 16 was regarded as the anode current and measured by a current measuring apparatus 76.

The manufactured X-ray generating apparatus was evaluated for stability and revealed to be capable of stable driving in which fluctuations in X-ray output were within 2% after pulses were applied 5,000 times. The anode 52 was dismantled after the driving evaluation in order to observe the brazing filler metal as the joining member 48 on the support substrate 21. The observation revealed that the brazing filler metal as the joining member 48 had not flowed over to the target layer 22, and that a covered portion where the conductive member 47 had covered the extended portion 48*a* had retained its shape.

Comparative Example 1

Figure 9A:
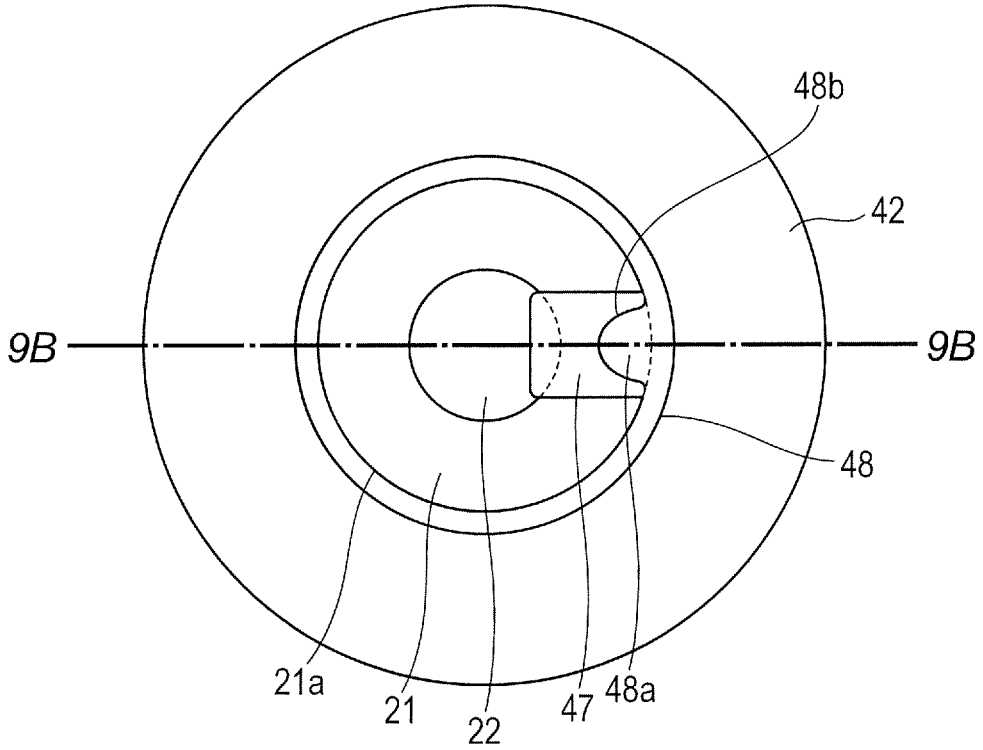
FIG. 9A is a diagram for schematically illustrating the structure of an anode according to a comparative example of the present invention, in the form of a plan view viewed from the cathode side of an X-ray generating tube.
Figure 9B:
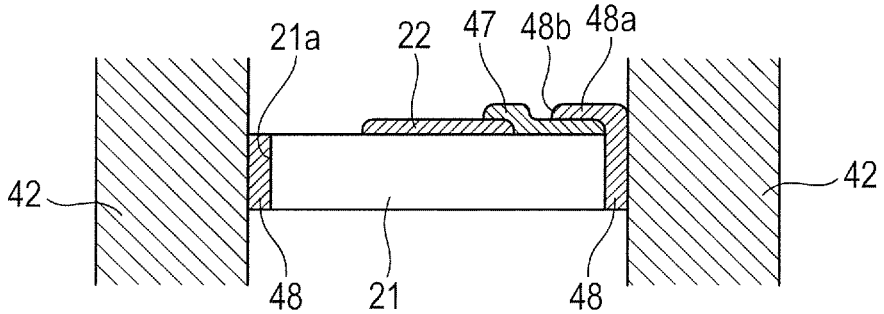
FIG. 9B is a sectional view taken along the line 9B-9B in FIG. 9A.

In Comparative Example 1, the target layer 22 was formed on the support substrate 21, the conductive member 47 electrically connected to the target layer 22 was formed next, and then a brazing filler metal was used as the material of the joining member 48 to join the support substrate 21 and the tubular anode member 42, and was electrically connected to the conductive member 47. The brazing filler metal as the joining member 48 in the anode 52 of Comparative Example 1 was found to extend onto the conductive member 47 as illustrated in FIG. 9A and FIG. 9B. FIG. 9A is a view of the anode of Comparative Example 1 that is viewed from the cathode side in the X-ray generating tube, and FIG. 9B is a sectional view taken along the line 9B-9B in FIG. 9A.

The anode 52 of Comparative Example 1 was used to manufacture an X-ray generating tube and also an X-ray generating apparatus as in Example 1 for driving evaluation. At the time when pulses were applied approximately 30 times, the X-ray output dropped by 10% or more and, when pulse application exceeded 500 times, discharge occurred rendering the X-ray generating apparatus undrivable. After the evaluation, the X-ray generating tube was dismantled in order to observe the anode. The observation revealed that the brazing filler metal as the joining member 48 had flowed over to a part of the target layer 22 and, in addition, had partially leaked out of the gap between the tubular anode member 42 and the support substrate 21 where vacuum sealing was supposed to be maintained, thereby causing a vacuum leak.

The process in which the vacuum leak occurred in Comparative Example 1 on top of the drop in X-ray output is surmised as follows:

In the X-ray emitting operation, a temperature rise in the target layer 22 and the support substrate 21 due to electron beam irradiation increases the temperature of the brazing filler metal as the joining member 48 and lowers the viscosity of the brazing filler metal. The end portion 48*b* of the extended portion 48*a* experiences thermal expansion at this point in a direction toward the target layer 22. The conductive member 47, which has high affinity to the brazing filler metal as the joining member 48, is reduced in viscosity and the thermally expanded extended portion 48*a* flows over the conductive member 47 toward the target layer 22. The extended portion 48*a* approaching the target layer 22 further rises in temperature and further decreases in viscosity. The viscosity of the brazing filler metal as the joining member 48 is thus reduced progressively with the repetition of the X-ray emitting operation. The brazing filler metal reduced in viscosity glides over the conductive member 47 and reaches the target layer 22, thereby hindering the intended X-ray emission and lowering the X-ray output. The flowing over of the brazing filler metal as the joining member 48 to the conductive member 47 pushes a part of the brazing filler metal that has filled the gap between the tubular anode member 42 and the support substrate 21 out onto the support substrate 21, thereby further causing the vacuum leak.

Example 2

Figure 7:
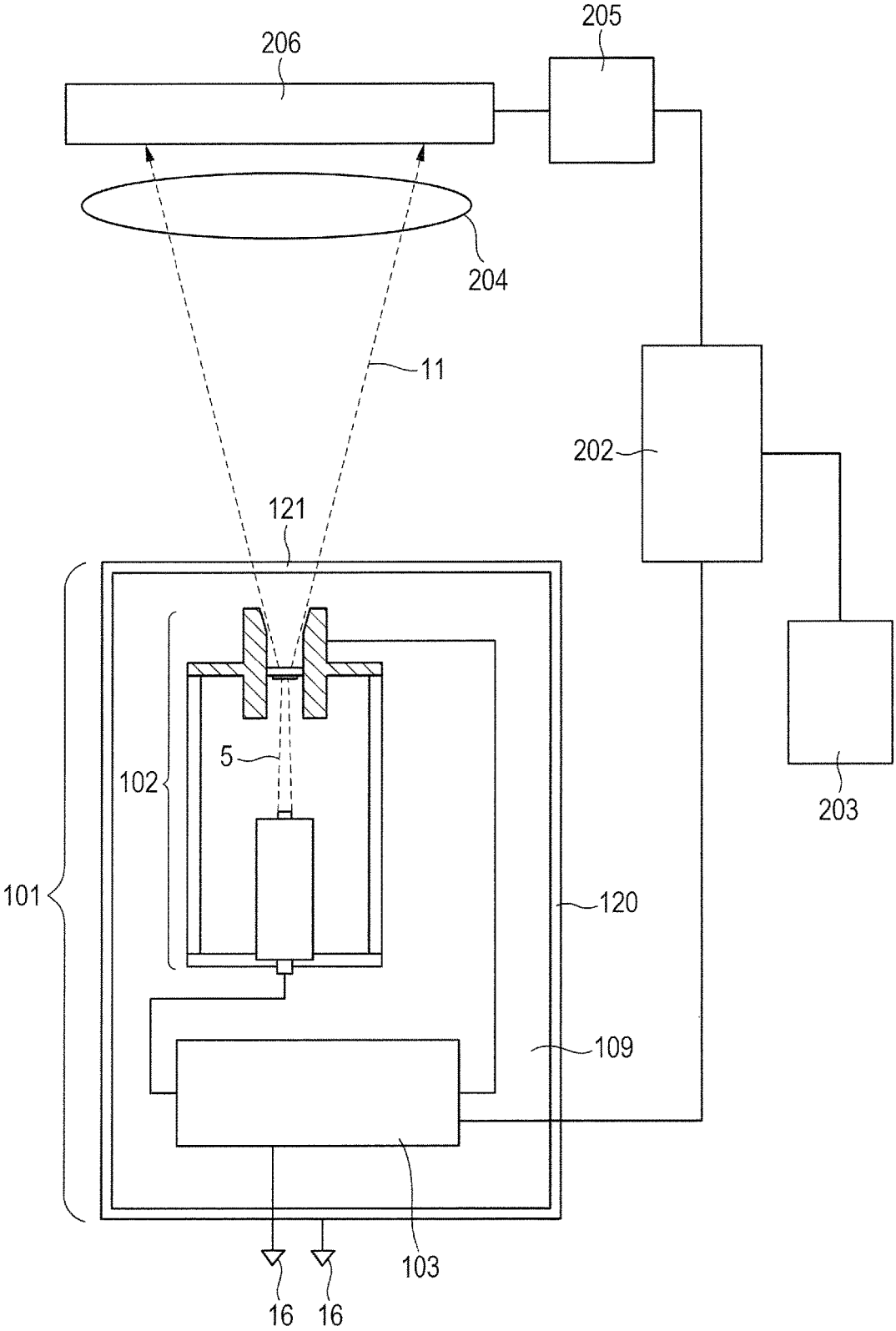
FIG. 7 is a diagram for schematically illustrating the structure of a radiography system according to an embodiment of the present invention.

In Example 2, the X-ray generating apparatus of Example 1 was used to construct the radiography system of FIG. 7.

Having the X-ray generating apparatus 101 in which discharge is prevented and fluctuations in anode current are reduced, the radiography system of Example 2 was successful in yielding an X-ray radiographic image free of fluctuations in imaging quality from imaging to imaging and high in SN ratio.

According to the present invention, where the joining member does not reach the target layer in the X-ray emitting operation, the quality of the emitted X-ray does not deteriorate and a desired X-ray is obtained. An X-ray generating tube that emits an X-ray of excellent characteristics is thus obtained, and a highly reliable X-ray generating apparatus and radiography system are provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-229593, filed Nov. 12, 2014, which is hereby incorporated by reference herein in its entirety.

What is claimed is:

1. An anode for an X-ray generating tube comprising:
a target layer configured to generate an X-ray;
a support substrate, which extends farther outwardly than an edge of the target layer, the support substrate comprising a support surface where the target layer is supported and a side surface connected to the support surface circumferentially;
a joining member including an extended portion which extends from the side surface to the support surface;
a tubular anode member, which is joined to the side surface via the joining member; and
a conductive layer having a melting point higher than a melting point of the joining member and which is configured to electrically connect the target layer and the joining member,
wherein the conductive layer is laid over the support surface and the extended portion of the joining member.

2. The anode according to claim 1, wherein the conductive layer covers the edge of the target layer.

3. The anode according to claim 1, wherein the conductive layer covers the joining member in a ring pattern.

4. The anode according to claim 1, wherein the joining member is lower in melting point than any one of the support substrate, the target layer, and the tubular anode member.

5. The anode according to claim 4, wherein the joining member is made of a brazing filler metal.

6. The anode according to claim 4, wherein the support substrate is made of diamond.

7. The anode according to claim 1, wherein the support substrate is joined to a tubular interior of the tubular anode member.

8. The anode according to claim 1, wherein the side surface comprises a surface that is continuous in a ring pattern along an edge of the support surface.

9. The anode according to claim 1,
wherein the support substrate is configured to transmit the X-ray generated in the target layer and emit the X-ray from a surface opposite from the support surface, and
wherein the target layer and the support substrate form a transmissive target.

10. An X-ray generating tube comprising:
an anode according to claim 1;
a cathode comprising an electron emitting source configured to emit electrons toward the target layer; and
an insulating tube configured to insulate the anode and the cathode and to form a vacuum container together with the anode and the cathode.

11. An X-ray generating apparatus comprising:
an X-ray generating tube according to claim 10; and
a tube voltage circuit configured to apply a tube voltage to the cathode and the anode of the X-ray generating tube.

12. A radiography system comprising:
an X-ray generating apparatus according to claim 11;
an X-ray detecting apparatus configured to detect an X-ray that has been emitted from the X-ray generating apparatus and transmitted through a subject; and
a system control apparatus configured to control the X-ray generating apparatus and the X-ray detecting apparatus in a coordinated manner.

13. The anode according to claim 1, wherein the conductive layer is coated on the support surface and the extended portion.

14. An anode for an X-ray generating tube comprising:

a target layer configured to generate an X-ray;

a support substrate, which extends farther outwardly than an edge of the target layer, the support substrate comprising a support surface where the target layer is supported;

a tubular anode member, which is joined to a side surface of the support substrate via a joining member, the joining member comprising an extended portion, which extends from the side surface to the support surface; and a conductive layer that has a melting point higher than a melting point of the joining member, wherein the joining member is electrically connected to the target layer by covering the extended portion with the conductive layer, and wherein the conductive layer comprises the target layer.

15. The anode according to claim 14, wherein the conductive layer covers the joining member in a ring pattern.

16. The anode according to claim 14, wherein the joining member is lower in melting point than any one of the support substrate, the target layer, and the tubular anode member.

17. The anode according to claim 16, wherein the joining member is made of a brazing filler metal.

18. The anode according to claim 16, wherein the support substrate is made of diamond.

19. The anode according to claim 14, wherein the support substrate is joined to a tubular interior of the tubular anode member.

20. The anode according to claim 14, wherein the side surface comprises a surface that is continuous in a ring pattern along an edge of the support surface.

21. The anode according to claim 14, wherein the support substrate is configured to transmit the X-ray generated in the target layer and emit the X-ray from a surface opposite from the support surface, and wherein the target layer and the support substrate form a transmissive target.

22. An X-ray generating tube comprising:

an anode according to claim 14;

a cathode comprising an electron emitting source configured to emit electrons toward the target layer; and an insulating tube configured to insulate the anode and the cathode and to form a vacuum container together with the anode and the cathode.

23. An X-ray generating apparatus comprising:

an X-ray generating tube according to claim 22; and a tube voltage circuit configured to apply a tube voltage to the cathode and the anode of the X-ray generating tube.

24. A radiography system comprising:

an X-ray generating apparatus according to claim 23;

an X-ray detecting apparatus configured to detect an X-ray that has been emitted from the X-ray generating apparatus and transmitted through a subject; and a system control apparatus configured to control the X-ray generating apparatus and the X-ray detecting apparatus in a coordinated manner.

* * * * *